US010658750B2

(12) United States Patent
Nilsson et al.

(10) Patent No.: US 10,658,750 B2
(45) Date of Patent: May 19, 2020

(54) REDUCED GAIN OF AN ANTENNA BEAM PATTERN

(71) Applicant: Telefonaktiebolaget LM Ericsson (publ), Stockholm (SE)

(72) Inventors: Andreas Nilsson, Göteborg (SE); Henrik Asplund, Stockholm (SE); Martin Johansson, Mölndal (SE); Claes Tidestav, Bålsta (SE)

(73) Assignee: Telefonaktiebolaget LM Ericsson (Publ), Stockholm (SE)

( * ) Notice: Subject to any disclaimer, the term of this patent is extended or adjusted under 35 U.S.C. 154(b) by 155 days.

(21) Appl. No.: 15/543,059

(22) PCT Filed: Jan. 29, 2015

(86) PCT No.: PCT/EP2015/051795
§ 371 (c)(1),
(2) Date: Jul. 12, 2017

(87) PCT Pub. No.: WO2016/119850
PCT Pub. Date: Aug. 4, 2016

(65) Prior Publication Data
US 2018/0026362 A1 Jan. 25, 2018

(51) Int. Cl.
*H01Q 3/00* (2006.01)
*H01Q 3/26* (2006.01)
*H01Q 3/36* (2006.01)

(52) U.S. Cl.
CPC ..... *H01Q 3/005* (2013.01); *H01Q 3/2611* (2013.01); *H01Q 3/36* (2013.01)

(58) Field of Classification Search
CPC combination set(s) only.
See application file for complete search history.

(56) References Cited

U.S. PATENT DOCUMENTS 5,440,318 A 8/1995 Butland et al.
5,592,179 A 1/1997 Windyka
(Continued)

FOREIGN PATENT DOCUMENTS

JP S61172411 * 8/1986 ..... H01Q 21/22
JP 2001211025 A 8/2001
(Continued)

*Primary Examiner* — Zhitong Chen
(74) *Attorney, Agent, or Firm* — Patent Portfolio Builders, PLLC

(57) ABSTRACT

The present disclosure relates to a wireless communication node (1) comprising at least one antenna arrangement (2, 2', 2"). Each antenna arrangement (2, 2', 2") comprises at least one antenna port (3), at least two antenna elements (4*a*, 4*b*, 5*a*, 5*b*, 6*a*, 6*b*, 7*a*, 7*b*) arranged for providing an antenna beam pattern (8), and a phase control arrangement (9, 9', 9") arranged to receive at least one input signal (10) via said antenna port (3) and to determine a plurality of intermediate signal components (11) from said input signal (10) by determining a first set of respective phase shifts (φ1, φ2, 10 φ3, φ4; θ1, θ2, θ3, θ4, θ5, θ6, θ7, θ8) for said input signal (3). The phase control arrangement (9) is further arranged to determine a final signal component (12) for each antenna element (4*a*, 4*b*, 5*a*, 5*b*, 6*a*, 6*b*, 7*a*, 7*b*) from said intermediate signal components (12) by determining a second set of respective phase shifts (β1, β2, β3, β4: Φ1, Φ2, Φ3, Φ4, Φ5, Φ6, Φ7, Φ8) for said intermediate signal components (12), wherein the second set of phase shifts (β1, β2, β3, β4; Φ1, Φ2, Φ3, Φ4, Φ5, Φ6, Φ7, Φ8) is arranged to provide a lowered gain of the antenna arrangement (2, 2', 2") in at least one direction (D). The present disclosure also relates to a corresponding method.

23 Claims, 6 Drawing Sheets

(56) References Cited

U.S. PATENT DOCUMENTS

| | | | | |
|---|---|---|---|---|
| 6,466,165 | B2 * | 10/2002 | Obayashi | H01Q 3/2605 342/372 |
| 2002/0047800 | A1 * | 4/2002 | Proctor, Jr. | H01Q 1/246 342/367 |
| 2003/0156061 | A1 * | 8/2003 | Ohira | H01Q 3/22 342/372 |
| 2005/0046514 | A1 * | 3/2005 | Janoschka | H01P 1/184 333/156 |
| 2006/0049984 | A1 | 3/2006 | Easton | |
| 2008/0278369 | A1 * | 11/2008 | Milano | G01S 7/032 342/175 |
| 2009/0295474 | A1 * | 12/2009 | Petersson | H01Q 3/28 330/126 |

FOREIGN PATENT DOCUMENTS

| | | | |
|---|---|---|---|
| WO | 2003036756 | A2 | 5/2003 |
| WO | 2007134615 | A1 | 11/2007 |

* cited by examiner

REDUCED GAIN OF AN ANTENNA BEAM PATTERN

TECHNICAL FIELD

The present disclosure relates to wireless communication systems, and in particular to controlling antenna beam patterns of an antenna arrangement having at least two antenna elements.

BACKGROUND

Future generations of cellular networks are expected to provide high data rates, up to several gigabytes per second while at the same time being energy efficient. One possible way to achieve such high data rates and/or to lower the energy consumption in cellular networks is to deploy a reconfigurable antenna system (RAS) or reconfigurable antenna systems. A RAS is an antenna system whose radiation characteristics can be changed by the network after deployment and adapted to, e.g., current traffic needs.

The most common antenna parameter that can be remotely controlled has been the antenna tilt. More possibilities to modify the antenna lobe shapes, far beyond the one-dimensional tilt, will be introduced, and this opens up for new possibilities to improve network performance. For example, an antenna system can be reconfigured to better serve a traffic hotspot by, e.g., increasing the antenna gain toward the hotspot location.

To efficiently use a RAS it has to be automatically controlled, for example by using a self-organizing network (SON) algorithm. A RAS controlled by SON algorithms is called RAS-SON. It is important to distinguish a RAS from UE-specific beamforming. A RAS is used to shape the cell-specific beam patterns for cell-specific reference signals (CRSs) and control signals, and is typically changed quite slowly, accommodating for changes in the infrastructure or user behaviors, for example on a weekly basis. The UE-specific beamforming is used to shape the beams for UE-specific signals and is typically changed very quickly, for example on a millisecond basis.

When steering the radiation pattern for reconfigurable antennas, there are typically some directions where it is un-desirable to transmit energy; for example at the horizon or at buildings with indoor systems. Tilting antennas towards the horizon in an urban scenario may lead to reduced performance in the network, for example due to a large amount of interference that will be generated towards other cells.

However, many algorithms that tune reconfigurable antennas, such as for example certain SON algorithms, do not consider any directions as undesired options. This may lead to unnecessarily slow adaption and to temporarily worse performance during the adaptation process, as these sub-optimal antenna settings are tried by the automatic algorithm.

Generally, it is desirable to obtain a reconfigurable and/or electrically controllable antenna arrangement where undesired radiation directions are automatically handled in an efficient, reliable and uncomplicated manner.

SUMMARY

An object of the present disclosure is to provide a reconfigurable and/or electrically controllable antenna arrangement where undesired radiation directions are automatically handled in an efficient, reliable and uncomplicated manner.

This object is achieved by a wireless communication node comprising at least one antenna arrangement, each antenna arrangement comprising at least one antenna port, at least two antenna elements arranged for providing an antenna beam pattern, and a phase control arrangement. The phase control arrangement is arranged to receive at least one input signal via said antenna port and to determine a plurality of intermediate signal components from said input signal by determining a first set of respective phase shifts for said input signal. The phase control arrangement is further arranged to determine a final signal component for each antenna element from said intermediate signal components by determining a second set of respective phase shifts for said intermediate signal components. The second set of phase shifts is arranged to provide a lowered gain of the antenna arrangement in at least one direction, such that the possible antenna beam patterns achievable by adjustment of said first phase shifts is constrained.

Said object is also achieved by a method for controlling an antenna beam for an antenna arrangement with at least two antenna elements in a wireless communication node. The method comprises determining a plurality of intermediate signal components from at least one input signal by determining a first set of respective phase shifts for said input signal; and determining a final signal component for each antenna element from said intermediate signal components by determining a second set of respective phase shifts for said intermediate signal components. The method further comprises determining the second set of phase shifts such that a lowered gain of the antenna arrangement in at least one direction is provided, such that the possible antenna beam patterns achievable by adjustment of said first phase shifts is constrained.

According to an example, the phase control arrangement comprises a first phase control module configured to receive a first phase control signal, and a second phase control module configured to receive a second phase control signal. The first phase control module is arranged to generate the intermediate signal components by applying a first set of phase shifts, which has been determined by means of the first phase control signal, to said input signal. The second phase control module is arranged to receive the intermediate signal components and to generate the final signal components by applying second set of phase shifts, which has been determined by means of the second phase control signal, to the intermediate signal components.

According to an example, the first phase control module comprises a first set of phase shifting devices arranged to generate the first set of phase shifts, and where the second phase control module comprises a second set of phase shifting devices arranged to generate the second set of phase shifts.

According to an example, the first phase control module comprises a digital signal processing unit that is arranged to determine and generate the first set phase shifts. Furthermore, the second phase control module comprises a second set of phase shifting devices arranged to generate the second set of phase shifts.

According to an example, each antenna arrangement comprises at least two sub-arrays, where each sub-array comprises two antenna elements and one phase shifting device.

According to an example, the phase control arrangement comprises a digital signal processing unit that is arranged to determine the first set of phase shifts and the second set of phase shifts. The digital signal processing unit is arranged to combine the first set of phase shifts and the second set of phase shifts to form a set of combined phase shifts. The phase control arrangement is arranged to generate the final signal components by applying the set of combined phase shifts to the input signal.

According to an example, each antenna arrangement is part of a reconfigurable antenna system (RAS) in a self-organizing network (SON).

Other examples are evident from the dependent claims.

A number of advantages are obtained by means of the present disclosure. Mainly, a reconfigurable and/or electrically controllable antenna arrangement is provided, where undesired radiation directions are automatically handled in an efficient, reliable and uncomplicated manner.

BRIEF DESCRIPTION OF THE DRAWINGS

The present disclosure will now be described more in detail with reference to the appended drawings, where.

DETAILED DESCRIPTION

Figure 1:
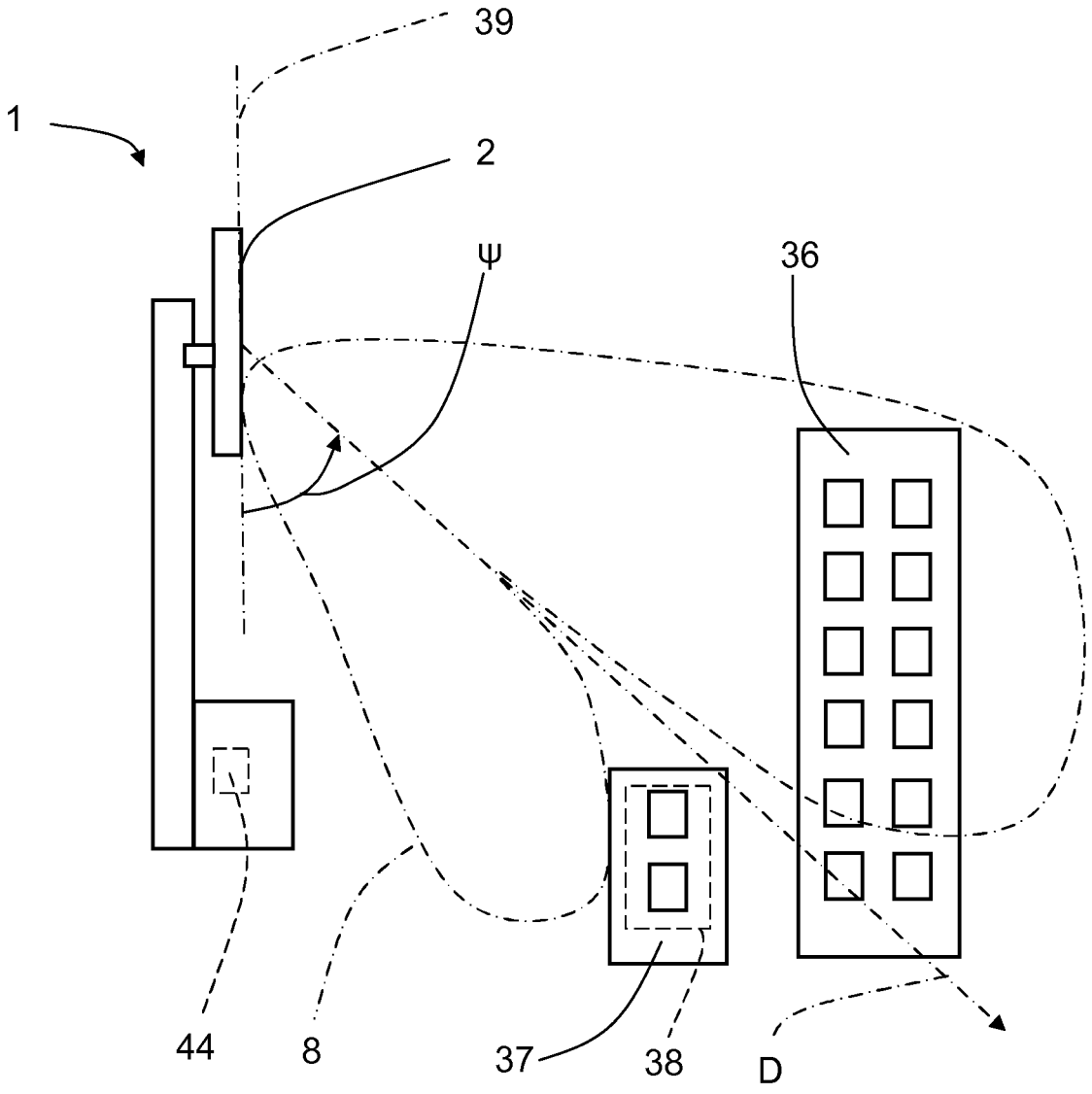
FIG. 1 shows a schematic side view of communication node arrangement.
Figure 2:
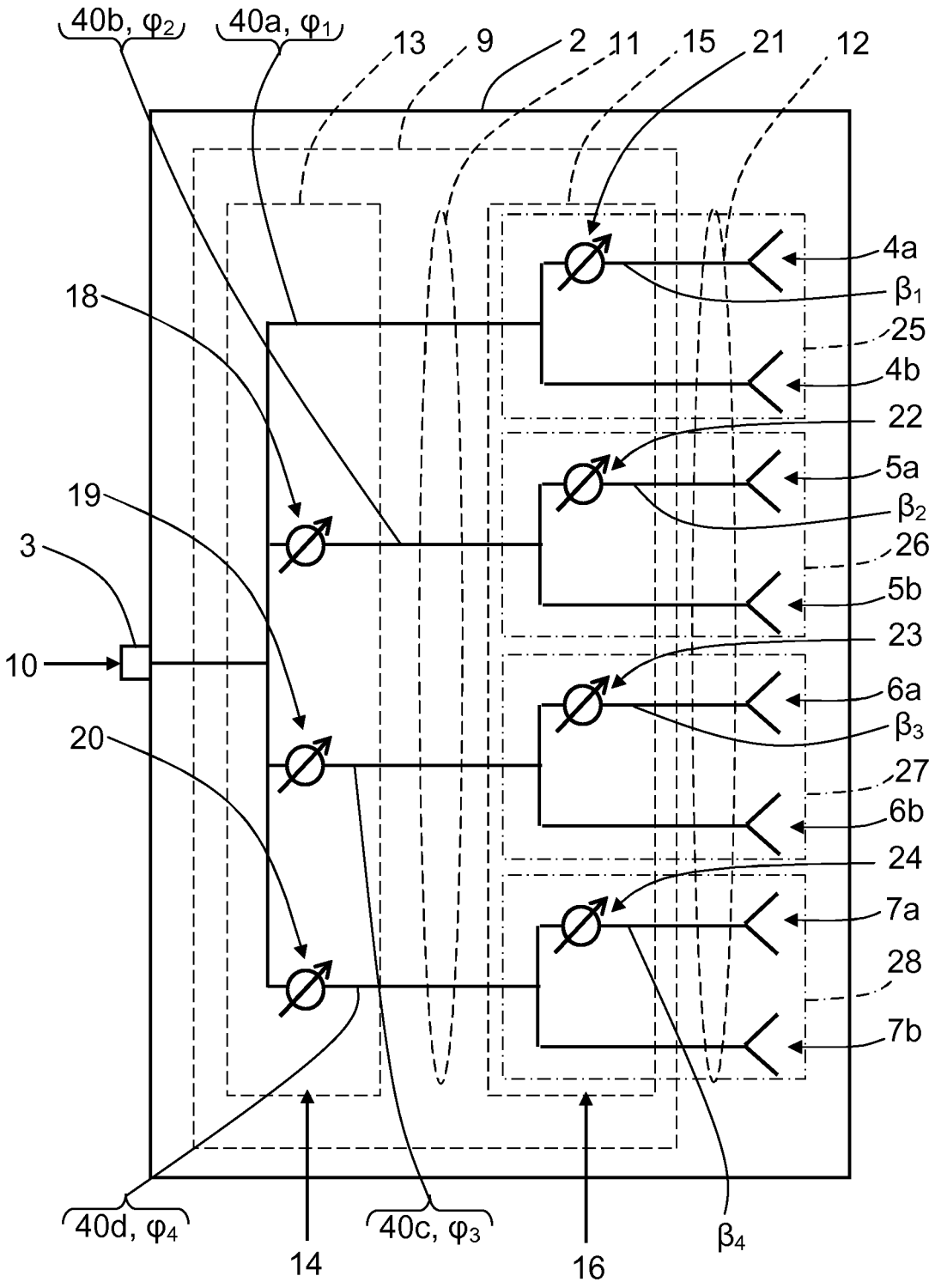
FIG. 2 shows a schematic view of a first example an antenna arrangement.

With reference to FIG. 1, there is a wireless communication node 1 comprising an antenna arrangement 2 that in this example is part of a reconfigurable antenna system (RAS) in a self-organizing network (SON). With reference also to FIG. 2, showing a first example, the antenna arrangement 2 comprises one antenna port 3, eight antenna elements 4*a*, 4*b*, 5*a*, 5*b*, 6*a*, 6*b*, 7*a*, 7*b* arranged for providing an antenna beam pattern 8, and a phase control arrangement 9 arranged to receive at least one input signal 10 via the antenna port 3. The antenna arrangement 2 comprises four sub-arrays 25, 26, 27, 28, where each sub-array 25, 26, 27, 28 comprises two antenna elements 4*a*, 4*b*; 5*a*, 5*b*; 6*a*, 6*b*; 7*a*, 7*b*.

In order to tune RAS settings, the phase control arrangement 9 is arranged to determine four intermediate signal components 11 from the input signal 10 by determining a first set of four respective phase shifts $\varphi_1$, $\varphi_2$, $\varphi_3$, $\varphi_4$ for the input signal 10. For this purpose, the phase control arrangement 9 comprises a first phase control module 13 configured to receive a first phase control signal 14 and to generate the intermediate signal components 11 by applying the first set of phase shifts $\varphi_1$, $\varphi_2$, $\varphi_3$, $\varphi_4$, which has been determined by means of the first phase control signal 14, to the input signal 10.

The first phase control module 13 comprises three phase shifting devices 18, 19, 20, constituting a first set of phase shifting devices, and are arranged to inflict corresponding phase shifts, where a first phase shift $\varphi_1$ equals 0° since there is no phase shifting device for a corresponding first intermediate signal branch 40*a*. A first phase shifting device 18 is arranged to inflict a second phase shift $\varphi_2$ for a corresponding second intermediate signal branch 40*b*, a second phase shifting device 19 is arranged to inflict a third phase shift $\varphi_3$ for a corresponding third intermediate signal branch 40*c*, and a third phase shifting device 20 is arranged to inflict a fourth phase shift $\varphi_4$ for a corresponding fourth intermediate signal branch 40*d*.

In FIG. 1, there is a first building 36 and a second building 37, where the second building 37 comprises an indoor system 38. When tuning RAS settings by means of the first set of phase shifts $\varphi_1$, $\varphi_2$, $\varphi_3$, $\varphi_4$, it is desired to avoid transmitting energy in a direction D towards the second building 37, since it is undesired to interfere with the existing indoor system 38. It will now be described how the antenna arrangement is configured to automatically present low transmit power in the direction D. The direction D presents an elevation angle $\psi$ to an antenna plane 39.

According to the present disclosure, the phase control arrangement 9 is further arranged to determine a final signal component 12 for each antenna element 4*a*, 4*b*, 5*a*, 5*b*, 6*a*, 6*b*, 7*a*, 7*b* from the intermediate signal components 12 by determining a second set of four respective phase shifts $\beta_1$, $\beta_2$, $\beta_3$, $\beta_4$ for the intermediate signal components 12. For this purpose, the phase control arrangement 9 comprises a second phase control module 15 that is configured to receive a second phase control signal 16 and to receive the intermediate signal components 11 and to generate the final signal components 12 by applying the second set of phase shifts $\beta_1$, $\beta_2$, $\beta_3$, $\beta_4$, which has been determined by means of the second phase control signal 16, to the intermediate signal components 11. In this example, eight final signal components 12 are thus determined from the four intermediate signal components 11 via the second phase control module 15.

The second set of phase shifts $\beta_1$, $\beta_2$, $\beta_3$, $\beta_4$ is arranged to provide a lowered gain of the antenna arrangement 2 in the direction D, such that the possible antenna beam patterns achievable by adjustment of the first set of phase shifts $\varphi_1$, $\varphi_2$, $\varphi_3$, $\varphi_4$ is constrained. This may also result in side-lobe suppression. The lowered gain results in reduced coverage in at least one direction or coverage sector, and may for example constitute a so-called null, i.e. more or less absence of coverage.

In the following, the reduced coverage, or gain, in the direction D will be assumed to be in the form of a null, although it is appreciated that there can, according to some aspects, be some residual power transmitted in the direction D.

In other words, by the present technique there is provided a reduced gain, herein referred to as a null, in the direction D. The direction D of the null is determined by the second set of phase shifts $\beta_1$, $\beta_2$, $\beta_3$, $\beta_4$, where said direction D remains substantially constant regardless of the setting of the first set of phase shifts $\varphi_1$, $\varphi_2$, $\varphi_3$, $\varphi_4$.

The second phase control module 15 comprises four phase shifting devices 21, 22, 23, 24, constituting a second set of phase shifting devices, where each sub-array 25, 26, 27, 28 comprises one phase shifting device 21, 22, 23, 24. More in detail, a first sub-array 25 comprises a first antenna element 4*a*, a second antenna element 4*b* and a fourth phase shifting device 21 connected to the first antenna element 4*a*; a second sub-array 26 comprises a third antenna element 5*a*, a fourth antenna element 5*b* and a fifth phase shifting device 22 connected to the third antenna element 5*a*; a third sub-array 27 comprises a fifth antenna element 6*a*, a sixth antenna element 6*b* and a sixth phase shifting device 23 connected to the fifth antenna element 6*a*; and a fourth sub-array 28 comprises a seventh antenna element 7*a*, an eighth antenna element 7*b* and a seventh phase shifting device 24 connected to the seventh antenna element 7*a*. For each sub-array 25, 26, 27, 28 there is thus two antenna elements 4*a*, 4*b*; 5*a*, 5*b*; 6*a*, 6*b*; 7*a*, 7*b* and one phase shifting device 21, 22, 23, 24, a phase shifting device being connected to only one of the antenna elements 4*a*, 4*b*; 5*a*, 5*b*; 6*a*, 6*b*; 7*a*, 7*b* in each sub-array 25, 26, 27, 28. A sub-array thus comprises an antenna element 4*a*, 5*a*, 6*a*, 7*a* that is connected to a phase shifting device 21, 22, 23, 24, and one antenna element 4*b*, 5*b*, 6*b*, 7*b* that is not connected to a phase shifting device.

The present problem is in this example solved by using sub-arrays with certain phase difference between the antenna elements. It is now possible to set the phase of the second set of phase shifting devices 21, 22, 23, 24 such that each sub-array 25, 26, 27, 28 has a null in a certain direction, here the direction D, and this null will be there regardless of how the first set of phase shifting devices 18, 19, 20 is tuned. In this way, a reconfigurable antenna arrangement that always has a null in a certain direction is obtained.

It is now possible to steer the antenna beam pattern 8 in different ways while at the same time always having a null towards the second building 37 in order to reduce the interference to the indoor users by setting appropriate phase settings on the second set of phase shifting devices 21, 22, 23, 24 such that the antenna beam pattern 8 for all four sub-arrays 25, 26, 27, 28 gets a null in direction D, towards the second building 37.

Then the tilt of the reconfigurable antenna can be controlled by the first set of phase shifting devices 18, 19, 20 without any risk of transmitting too much energy towards the second building 37. This significantly reduces the interference towards the second building 37.

In order to be able to change the direction of the null in a sufficient way if necessary, the second set of phase shifting devices 21, 22, 23, 24 may according to an example be able to change the phase settings from 0° to at least 180°. If for some reason no null is needed in any direction at a certain moment, the second set of phase shifting devices 21, 22, 23, 24 could be used as normal phase shifters. In this example, as well as generally, it is important to have different phase steering for, on one hand, the first set of phase shifting devices 18, 19, 20 and, on the other hand, the second set of phase shifting devices 21, 22, 23, 24. This is obtained by means of the first phase control signal 14 and the second phase control signal 16.

In order to obtain the above, it is desirable to first find a direction where it is un-desirable to transmit energy, and this could be done in many different ways. One way is to visually analyze the deployment and for example finding directions of buildings with indoor system or the like. The undesirable direction could also be found before deployment; in an urban scenario it may for example be undesirable to transmit energy in the direction of the horizon.

Another way to determine the undesirable direction is to use a cell planning tool to do interference analysis which then could be updated when changes occur in the deployment, e.g., when a new building or site appears in the network. Yet another way is to use continuous, non-disruptive measurements in the network. According to such an example, pilot signals, e.g. multiple CSI-RS (Channel State Information-Reference Signals) processes in LTE (Long-Term Evolution) or the like, are transmitted in narrow antenna radiation beams from a corresponding cell and user terminals connected to neighbouring cells can do received power measurements, CSI-RS Received Power, (CSI-RSRP) and report it back to the network. Based on these reports, estimates of generated interference in different directions could be evaluated.

Then, the phase settings of the second set of phase shifting devices 21, 22, 23, 24 are changed such that the resulting radiation pattern for respective sub-array gets a null, or at least a lowered gain, in the un-desirable direction, here the direction D. When this is done, the first set of phase shifting devices 18, 19, 20 may be used to steer the antenna beam pattern 8 of the antenna elements 4*a*, 4*b*, 5*a*, 5*b*, 6*a*, 6*b*, 7*a*, 7*b*.

The above may for example, at least partly, be performed by at least one control unit 44, as schematically indicated in FIG. 1. Such a control unit 1 may be positioned at any suitable place; for example at the node 1, inside or outside the antenna arrangement 2, 2', 2", or at a central location remote from the node 1. Such a control unit 44 may also be arranged to the form and transmit appropriate phase control signals 14, 14', 16; 42.

Figure 3:
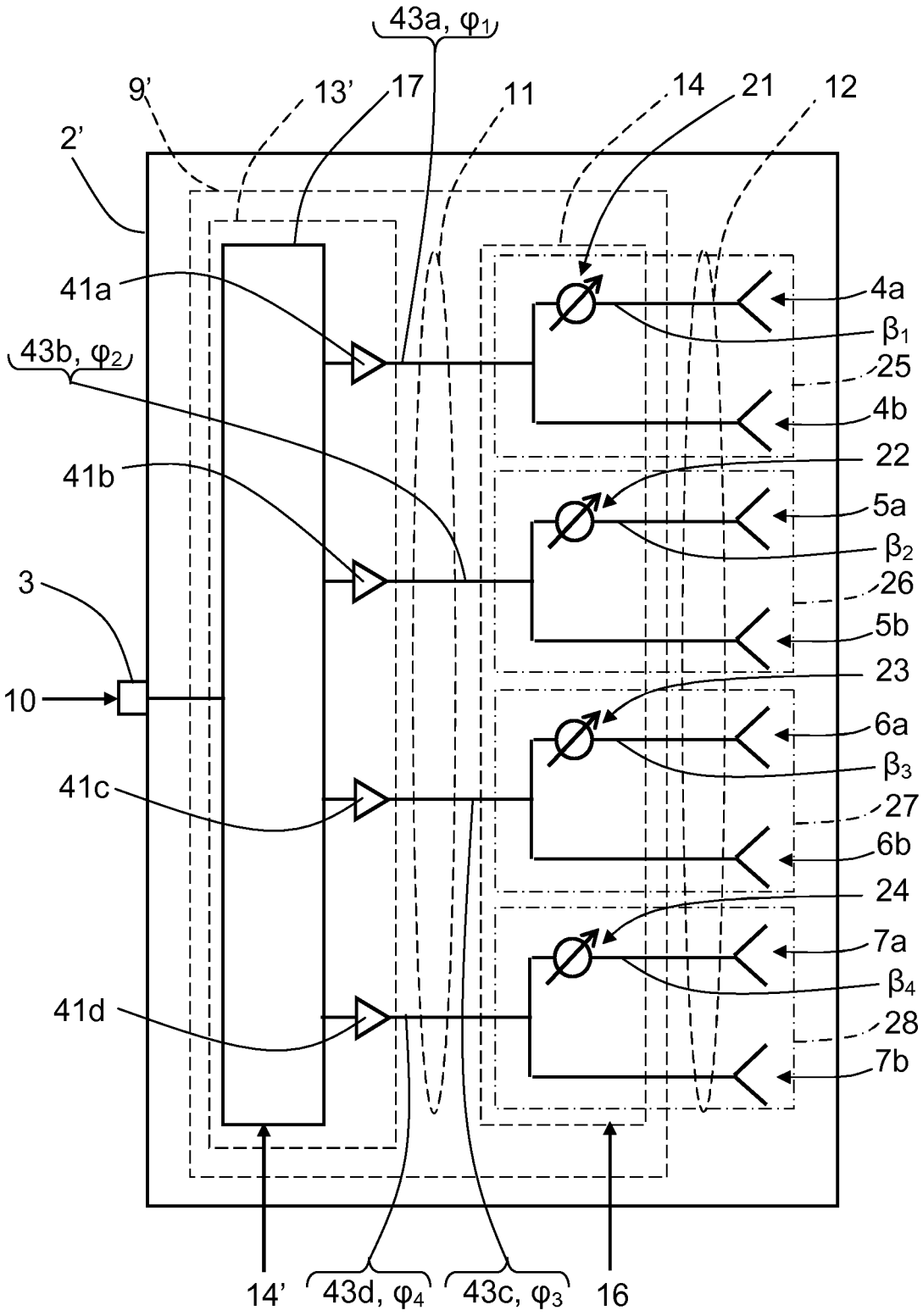
FIG. 3 shows a schematic view of a second example an antenna arrangement.

According to a second example with reference to FIG. 3, the antenna arrangement 2' comprises a phase control arrangement 9' that in turn comprises a first phase control module 13'. Here, the first phase control module 13' comprises a digital signal processing unit 17 that is arranged to determine first set of phase shifts $\varphi_1$, $\varphi_2$, $\varphi_3$, $\varphi_4$. A second phase control module 15 comprises four phase shifting devices 21, 22, 23, 24 as in the first example.

More in detail, the first phase control module 13' is configured to receive a first phase control signal 14' and to generate the intermediate signal components 11 by applying the determined first set of phase shifts $\varphi_1$, $\varphi_2$, $\varphi_3$, $\varphi_4$ to the input signal 10. The first phase control module 13' is arranged to inflict a respective first phase shift $\varphi_1$, second phase shift $\varphi_2$, third phase shift $\varphi_3$ and fourth phase shift $\varphi_4$ for a corresponding respective first intermediate signal branch 43*a*, second intermediate signal branch 43*b*, third intermediate signal branch 43*c* and fourth intermediate signal branch 43*d*. The first phase control module 13' also comprises distributed amplifiers 41*a*, 41*b*, 41*c*, 41*d*; at least one for each intermediate signal branch 43*a*, 43*b*, 43*c*, 43*d*.

The second example thus shows an antenna arrangement 2' having a similar functionality as the antenna arrangement 2 of the first example. However, here the beamforming that in first example was made by the first set of phase shifting devices 18, 19, 20 will here be done digitally. The first phase control module 13' is controlled by the corresponding first phase control signal 14'.

Figure 4:
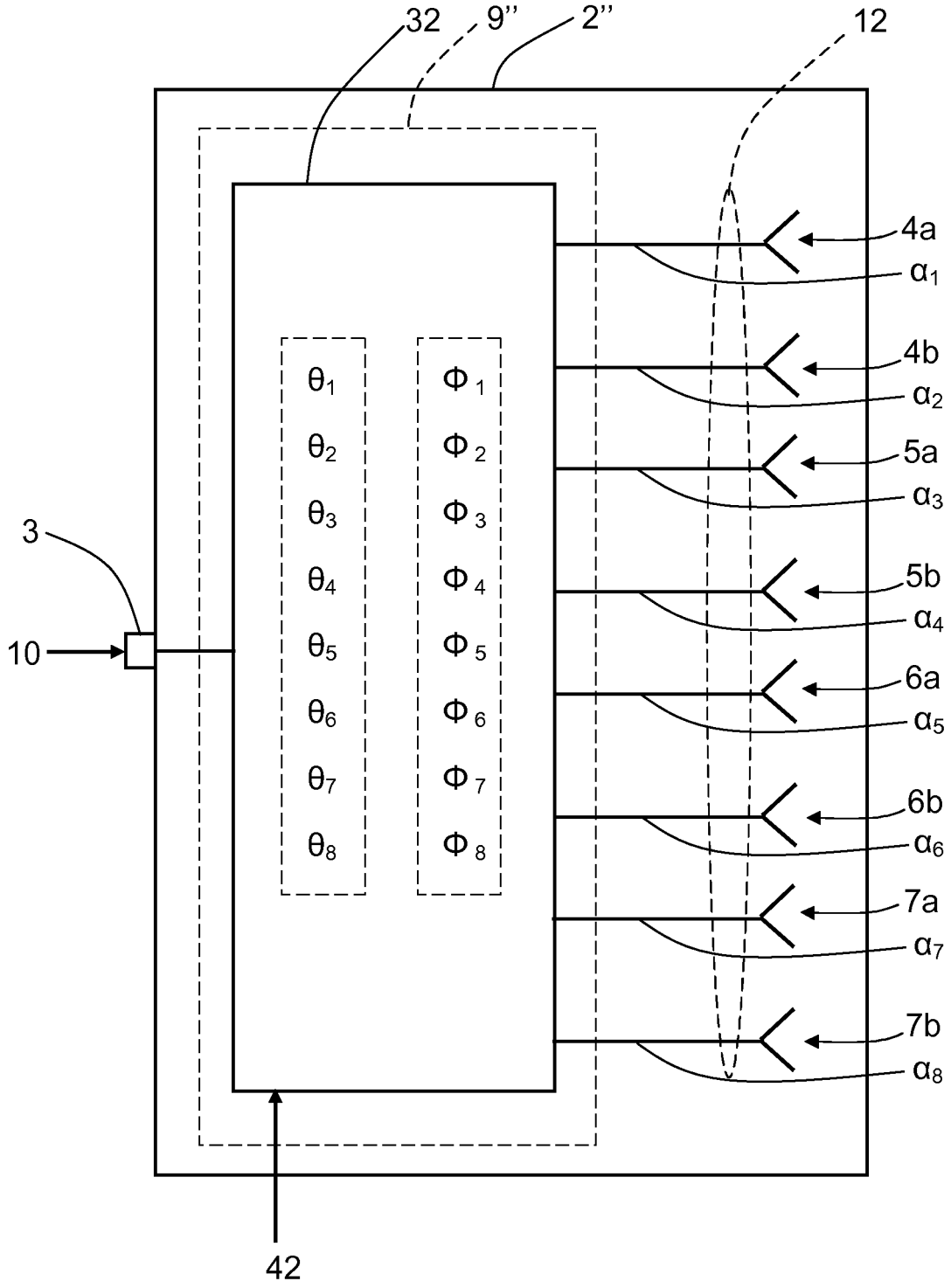
FIG. 4 shows a schematic view of a third example an antenna arrangement.

According to a third example with reference to FIG. 4, the antenna arrangement 2" comprises a phase control arrangement 9" that in turn comprises a digital signal processing unit 32 that is arranged to determine a first set of phase shifts $\theta_1$, $\theta_2$, $\theta_3$, $\theta_4$, $\theta_5$, $\theta_6$, $\theta_7$, $\theta_8$ and a second set of phase shifts $\Phi_1$, $\Phi_2$, $\Phi_3$, $\Phi_4$, $\Phi_5$, $\Phi_6$, $\Phi_7$, $\Phi_8$. The digital signal processing unit 32 is arranged to combine the first set of phase shifts $\theta_1$, $\theta_2$, $\theta_3$, $\theta_4$, $\theta_5$, $\theta_6$, $\theta_7$, $\theta_8$ and the second set phase shifts $\Phi_1$, $\Phi_2$, $\Phi_3$, $\Phi_4$, $\Phi_5$, $\Phi_6$, $\Phi_7$, $\Phi_8$ to form a set of combined phase shifts $\alpha_1$, $\alpha_2$, $\alpha_3$, $\alpha_4$, $\alpha_5$, $\alpha_6$, $\alpha_7$, $\alpha_8$; one for each antenna element 4*a*, 4*b*, 5*a*, 5*b*, 6*a*, 6*b*, 7*a*, 7*b*. The phase control arrangement 9" is arranged to generate the final signal components 12 by applying the set of combined phase shifts $\alpha_1$, $\alpha_2$, $\alpha_3$, $\alpha_4$, $\alpha_5$, $\alpha_6$, $\alpha_7$, $\alpha_8$ to the input signal 10 directly. In this example, there are no special sub-arrays formed, but only an array of antenna elements.

The third example shows an antenna arrangement 2" having a similar functionality as the antenna arrangements 2, 2' of the first example and second example. However, all phase shifting is here done digitally and in one step, for example by means of the SON. All antenna elements 4*a*, 4*b*, 5*a*, 5*b*, 6*a*, 6*b*, 7*a*, 7*b* are connected directly to the phase control arrangement 9", no sub-arrays being explicitly present. The digital signal processing unit 32 is controlled by a phase control signal 42. The digital signal processing unit 32 may comprise distributed amplifiers (not shown). In the third example, where all phase shifts are determined digitally, it is possible that the RAS-SON algorithm is adapted such that it excludes certain directions, i.e. those directions in which the gain of the antenna arrangement is to be lowered.

For all three examples above, it is possible to obtain antenna radiation patterns for reconfigurable antennas which will reduce the time consumption and degradation in the network during RAS tuning in an uncomplicated manner.

Figure 5:
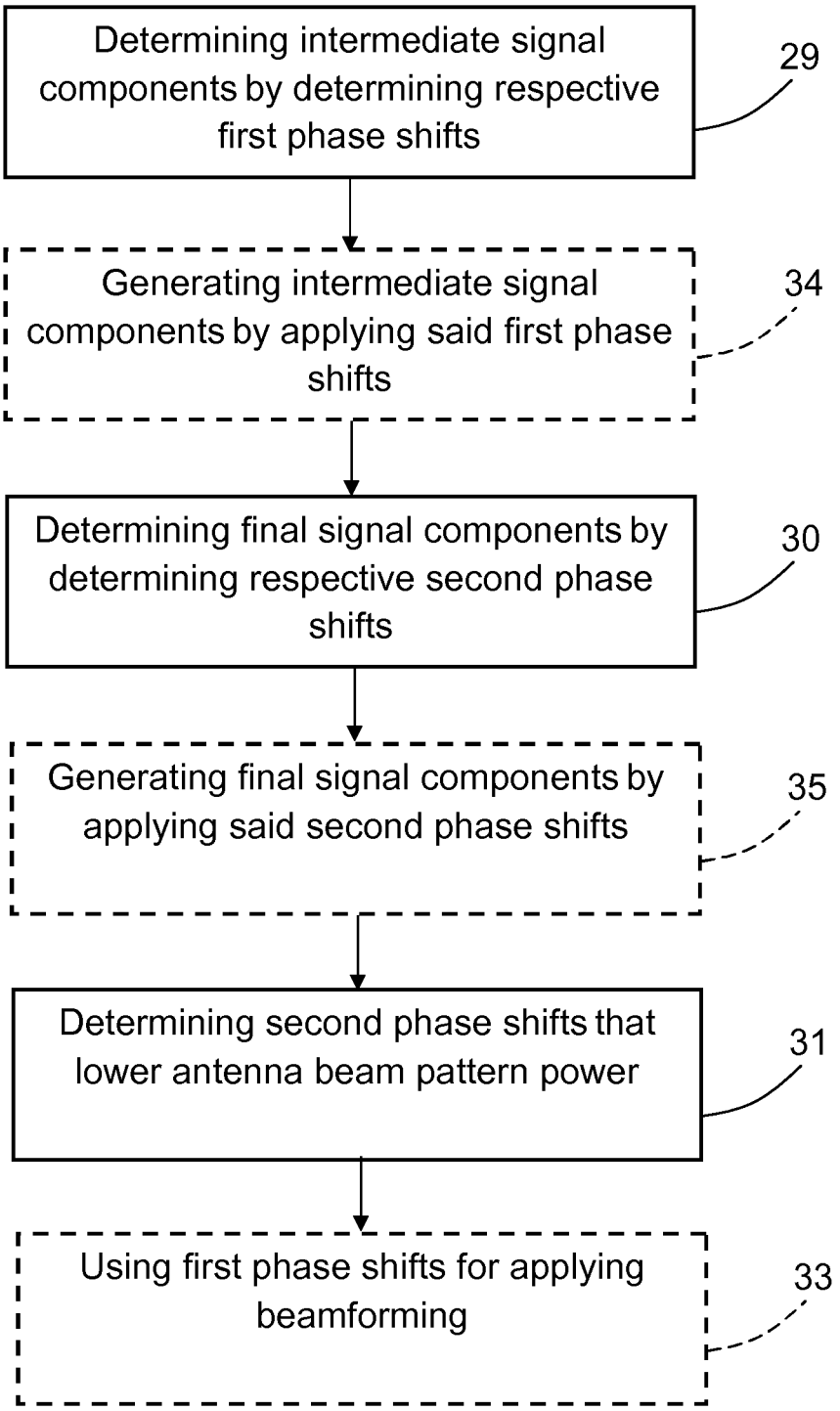
FIG. 5 shows a flowchart illustrating methods according to the present disclosure.

The examples above have been described for a RAS in a SON, but of course the present disclosure may be applied for any type of electrically controllable antenna arrangement where undesired radiation directions are automatically handled in an efficient, reliable and uncomplicated manner With reference to FIG. 5, the present disclosure also applies to a method for controlling an antenna beam 8 for an antenna arrangement 2 with at least two antenna elements 4*a*, 4*b*, 5*a*, 5*b*, 6*a*, 6*b*, 7*a*, 7*b* in a wireless communication node 1.

The method comprises:

29: Determining a plurality of intermediate signal components 11 from at least one input signal 10 by determining a first set of respective phase shifts $\varphi_1$, $\varphi_2$, $\varphi_3$, $\varphi_4$; $\theta_1$, $\theta_2$, $\theta_3$, $\theta_4$, $\theta_5$, $\theta_6$, $\theta_7$, $\theta_8$ for said input signal 10.

30: Determining a final signal component 12 for each antenna element 4*a*, 4*b*, 5*a*, 5*b*, 6*a*, 6*b*, 7*a*, 7*b* from said intermediate signal components 11 by determining a second set of respective phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_8$ for said intermediate signal components 11.

31: Determining the second set of phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_8$ such that a lowered gain of the antenna arrangement 2, 2', 2" in at least one direction D is provided, such that the possible antenna beam patterns achievable by adjustment of said first phase shifts is constrained.

According to an example, the method comprises:

33: using the first set of phase shifts $\varphi_1$, $\varphi_2$, $\varphi_3$, $\varphi_4$ for applying beamforming.

According to an example, the method comprises:

34: generating intermediate signal components 11 by applying the first set of phase shifts $\varphi_1$, $\varphi_2$, $\varphi_3$, $\varphi_4$ to said input signal 10, and

35: generating the final signal components 12 by applying the second set of phase shifts $\beta_1$, $\beta_2$, $\beta_3$, $\beta_4$ to the intermediate signal components 11.

The present disclosure is not limited to the above example, but may vary freely within the scoop of the appended claims. For example, there may any number of antenna ports and input signals, but at least one input port 3 and at least one input signal 10. There may be any suitable number of intermediate signal components 11 and final signal components 12.

The wireless communication node 1 may comprise more than one antenna arrangement, and each antenna arrangement comprises at least two antenna elements.

When phase shifting devices are used, each set of phase shifting devices comprises at least one phase shifting device. In the first example there is two sets of phase shifting devices 18, 19, 20; 21, 22, 23, 24, and in the second example, there is one set of phase shifting devices 21, 22, 23, 24.

When there are sub-arrays, each sub-array comprises at least two antenna elements.

The first set of phase shifts $\varphi_1$, $\varphi_2$, $\varphi_3$, $\varphi_4$; $\theta_1$, $\theta_2$, $\theta_3$, $\theta_4$, $\theta_5$, $\theta_6$, $\theta_7$, $\theta_8$ may comprise adaptable phase shifts, and the second set of phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_8$ may comprise pre-determined phase shifts.

When a second phase control module 15 is used having sub-arrays according to the above, there may be more than two antenna elements in each sub-array, and all antenna elements in each sub-array may, or may not, be connected to a phase shifting device. According to an example, for each sub-array, at least one antenna element may be connected to a phase shifting device. In this case, according to an example, the phase shifts in the second set of phase shifts $\beta_1$, $\beta_2$, $\beta_3$, $\beta_4$ may be identical. That means that an antenna arrangement 2, 2' may comprise identical sub-arrays with identical phase shifts.

When a second phase control module 15 is used, dividing the antenna elements into sub-arrays is not necessary, but merely an example of how to realize the antenna arrangement 2, 2' and the second phase control module 15.

The lowered gain may be obtained in several directions. In each such direction, the gain is in practice lowered in a certain angular sector, where the minimum gain is obtained in each such direction.

Expressions such as identical and equal are not intended to be interpreted literally, but within what is practically obtainable with in this field of technology.

Generally, the present disclosure relates to a wireless communication node 1 comprising at least one antenna arrangement 2, 2', 2", each antenna arrangement 2, 2', 2" comprising at least one antenna port 3, at least two antenna elements 4*a*, 4*b*, 5*a*, 5*b*, 6*a*, 6*b*, 7*a*, 7*b* arranged for providing an antenna beam pattern 8, and a phase control arrangement 9, 9', 9" arranged to receive at least one input signal 10 via said antenna port 3 and to determine a plurality of intermediate signal components 11 from said input signal 10 by determining a first set of respective phase shifts $\varphi_1$, $\varphi_2$, $\varphi_3$, $\varphi_4$; $\theta_1$, $\theta_2$, $\theta_3$, $\theta_4$, $\theta_5$, $\theta_6$, $\theta_7$, $\theta_8$ for said input signal 3. The phase control arrangement 9 is further arranged to determine a final signal component 12 for each antenna element 4*a*, 4*b*, 5*a*, 5*b*, 6*a*, 6*b*, 7*a*, 7*b* from said intermediate signal components 12 by determining a second set of respective phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_9$ for said intermediate signal components 12, wherein the second set of phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_8$ is arranged to provide a lowered gain of the antenna arrangement 2, 2', 2" in at least one direction D, such that the possible antenna beam patterns achievable by adjustment of said first phase shifts is constrained.

According to an example, the first set of phase shifts $\varphi_1$, $\varphi_2$, $\varphi_3$, $\varphi_4$ is arranged for applying beamforming.

According to an example, the phase control arrangement 9, 9' comprises a first phase control module 13, 13' configured to receive a first phase control signal 14, 14' and a second phase control module 15 configured to receive a second phase control signal 16, where the first phase control module 13, 13' is arranged to generate the intermediate signal components 11 by applying a first set of phase shifts $\varphi_1$, $\varphi_2$, $\varphi_3$, $\varphi_4$, which has been determined by means of the first phase control signal 14, 14', to said input signal 10, and where the second phase control module 15 is arranged to receive the intermediate signal components 11 and to generate the final signal components 12 by applying second set of phase shifts $\beta_1$, $\beta_2$, $\beta_3$, $\beta_4$, which has been determined by means of the second phase control signal 16, to the intermediate signal components 11.

According to an example, a control unit 44 is arranged to the form and transmit appropriate phase control signals 14, 14', 16.

According to an example, the first phase control module 13 comprises a first set of phase shifting devices 18, 19, 20 arranged to generate the first set of phase shifts $\varphi_1$, $\varphi_2$, $\varphi_3$, $\varphi_4$, and where the second phase control module 15 comprises a second set of phase shifting devices 21, 22, 23, 24 arranged to generate the second set of phase shifts $\beta_1$, $\beta_2$, $\beta_3$, $\beta_4$.

According to an example, the first phase control module 13' comprises a digital signal processing unit 17 that is arranged to determine and generate the first set phase shifts $\varphi_1$, $\varphi_2$, $\varphi_3$, $\varphi_4$, and where the second phase control module 15 comprises a second set of phase shifting devices 21, 22, 23, 24 arranged to generate the second set of phase shifts $\beta_1$, $\beta_2$, $\beta_3$, $\beta_4$.

According to an example, the first phase control module 13' comprises distributed amplifiers 41*a*, 41*b*, 41*c*, 41*d*.

According to an example, each antenna arrangement 2, 2' comprises at least two sub-arrays 25, 26, 27, 28, each sub-array 25, 26, 27, 28 comprising two antenna elements 4*a*, 4*b*, 5*a*, 5*b*, 6*a*, 6*b*, 7*a*, 7*b* and one phase shifting device 21, 22, 23, 24.

According to an example, the sub-arrays 25, 26, 27, 28 comprised in said antenna arrangement 2, 2' are identical.

According to an example, the first set of phase shifts $\varphi_1$, $\varphi_2$, $\varphi_3$, $\varphi_4$ comprises adaptable phase shifts, and the second set of phase shifts $\beta_1$, $\beta_2$, $\beta_3$, $\beta_4$ comprises pre-determined phase shifts.

According to an example, the phase shifts in the second set of phase shifts $\beta_1$, $\beta_2$, $\beta_3$, $\beta_4$ have mutually equal values.

According to an example, the phase control arrangement 9" comprises a digital signal processing unit 32 that is arranged to determine the first set of phase shifts $\theta_1$, $\theta_2$, $\theta_3$, $\theta_4$, $\theta_5$, $\theta_6$, $\theta_7$, $\theta_8$ and the second set of phase shifts $\Phi_1$, $\Phi_2$, $\Phi_3$, $\Phi_4$, $\Phi_5$, $\Phi_6$, $\Phi_7$, $\Phi_8$, and which digital signal processing unit 32 is arranged to combine the first set of phase shifts $\theta_1$, $\theta_2$, $\theta_3$, $\theta_4$, $\theta_5$, $\theta_6$, $\theta_7$, $\theta_8$ and the second set of phase shifts $\Phi_1$, $\Phi_2$, $\Phi_3$, $\Phi_4$, $\Phi_6$, $\Phi_6$, $\Phi_7$, $\Phi_8$ to form a set of combined phase shifts $\alpha_1$, $\alpha_2$, $\alpha_3$, $\alpha_4$, $\alpha_5$, $\alpha_6$, $\alpha_7$, $\alpha_8$ where the phase control arrangement 9" is arranged to generate the final signal components 12 by applying the set of combined phase shifts $\alpha_1$, $\alpha_2$, $\alpha_3$, $\alpha_4$, $\alpha_5$, $\alpha_6$, $\alpha_7$, $\alpha_8$ to said input signal 10.

According to an example, a control unit 44 is arranged to the form and transmit appropriate phase control signals 42 to the digital signal processing unit 32.

According to an example, each antenna arrangement 2, 2', 2" is part of a reconfigurable antenna system (RAS) in a self-organizing network (SON).

Generally, the present disclosure also relates to a method for controlling an antenna beam 8 for an antenna arrangement 2 with at least two antenna elements 4*a*, 4*b*, 5*a*, 5*b*, 6*a*, 6*b*, 7*a*, 7*b* in a wireless communication node 1, where the method comprises:

29: determining a plurality of intermediate signal components 11 from at least one input signal 10 by determining a first set of respective phase shifts $\varphi_1$, $\varphi_2$, $\varphi_3$, $\varphi_4$; $\theta_1$, $\theta_2$, $\theta_3$, $\theta_4$, $\theta_5$, $\theta_6$, $\theta_7$, $\theta_8$ for said input signal 10;

30: determining a final signal component 12 for each antenna element 4*a*, 4*b*, 5*a*, 5*b*, 6*a*, 6*b*, 7*a*, 7*b* from said intermediate signal components 11 by determining a second set of respective phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_8$ for said intermediate signal components 11; and

31: determining the second set of phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_8$ such that a lowered gain of the antenna arrangement 2, 2', 2" in at least one direction D is provided, such that the possible antenna beam patterns achievable by adjustment of said first phase shifts is constrained.

According to an example, the method comprises:

33: using the first set of phase shifts $\varphi_1$, $\varphi_2$, $\varphi_3$, $\varphi_4$ for applying beamforming.

According to an example, the method comprises:

34: generating intermediate signal components 11 by applying the first set of phase shifts $\varphi_1$, $\varphi_2$, $\varphi_3$, $\varphi_4$ to said input signal 10, and

35: generating the final signal components 12 by applying the second set of phase shifts $\beta_1$, $\beta_2$, $\beta_3$, $\beta_4$ to the intermediate signal components 11.

According to an example, a first set of phase shifting devices 18, 19, 20 is used for generating the first set of phase shifts $\varphi_1$, $\varphi_2$, $\varphi_3$, $\varphi_4$, and where a second set of phase shifting devices 21, 22, 23, 24 is used for generating the second set of phase shifts $\beta_1$, $\beta_2$, $\beta_3$, $\beta_4$.

According to an example, a digital signal processing unit 17 that is arranged to is used for generating the first set of phase shifts $\varphi_1$, $\varphi_2$, $\varphi_3$, $\varphi_4$, and where a second set of phase shifting devices 21, 22, 23, 24 is used for generating the second set of phase shifts $\beta_1$, $\beta_2$, $\beta_3$, $\beta_4$.

According to an example, the first set of phase shifts $\varphi_1$, $\varphi_2$, $\varphi_3$, $\varphi_4$ has adaptable phase shifts, and the second set of phase shifts $\beta_1$, $\beta_2$, $\beta_3$, $\beta_4$ has pre-determined phase shifts.

According to an example, the phase shifts in the second set of phase shifts $\oplus_1$, $\beta_2$, $\beta_3$, $\beta_4$ have mutually equal values.

According to an example, a digital signal processing unit 32 is used to determine the first set of phase shifts $\theta_1$, $\theta_2$, $\theta_3$, $\theta_4$, $\theta_5$, $\theta_6$, $\theta_7$, $\theta_8$ and the second set of phase shifts $\Phi_1$, $\Phi_2$, $\Phi_3$, $\Phi_4$, $\Phi_5$, $\Phi_6$, $\Phi_7$, $\Phi_8$ and which digital signal processing unit 32 is used to combine the first set of phase shifts $\theta_1$, $\theta_2$, $\theta_3$, $\theta_4$, $\theta_5$, $\theta_6$, $\theta_7$, $\theta_8$ and the second set of phase shifts $\Phi_1$, $\Phi_2$, $\Phi_3$, $\Phi_4$, $\Phi_5$, $\Phi_6$, $\Phi_7$, $\Phi_8$ to form a set of combined phase shifts $\alpha_1$, $\alpha_2$, $\alpha_3$, $\alpha_4$, $\alpha_5$, $\alpha_6$, $\alpha_7$, $\alpha_8$ where the phase control arrangement 9" is used to generate the final signal components 12 by applying the set of combined phase shifts $\alpha_1$, $\alpha_2$, $\alpha_3$, $\alpha_4$, $\alpha_5$, $\alpha_6$, $\alpha_7$, $\alpha_8$ to said input signal 10.

According to an example, the method is used in a reconfigurable antenna system (RAS) in a self-organizing network (SON).

Figure 6:
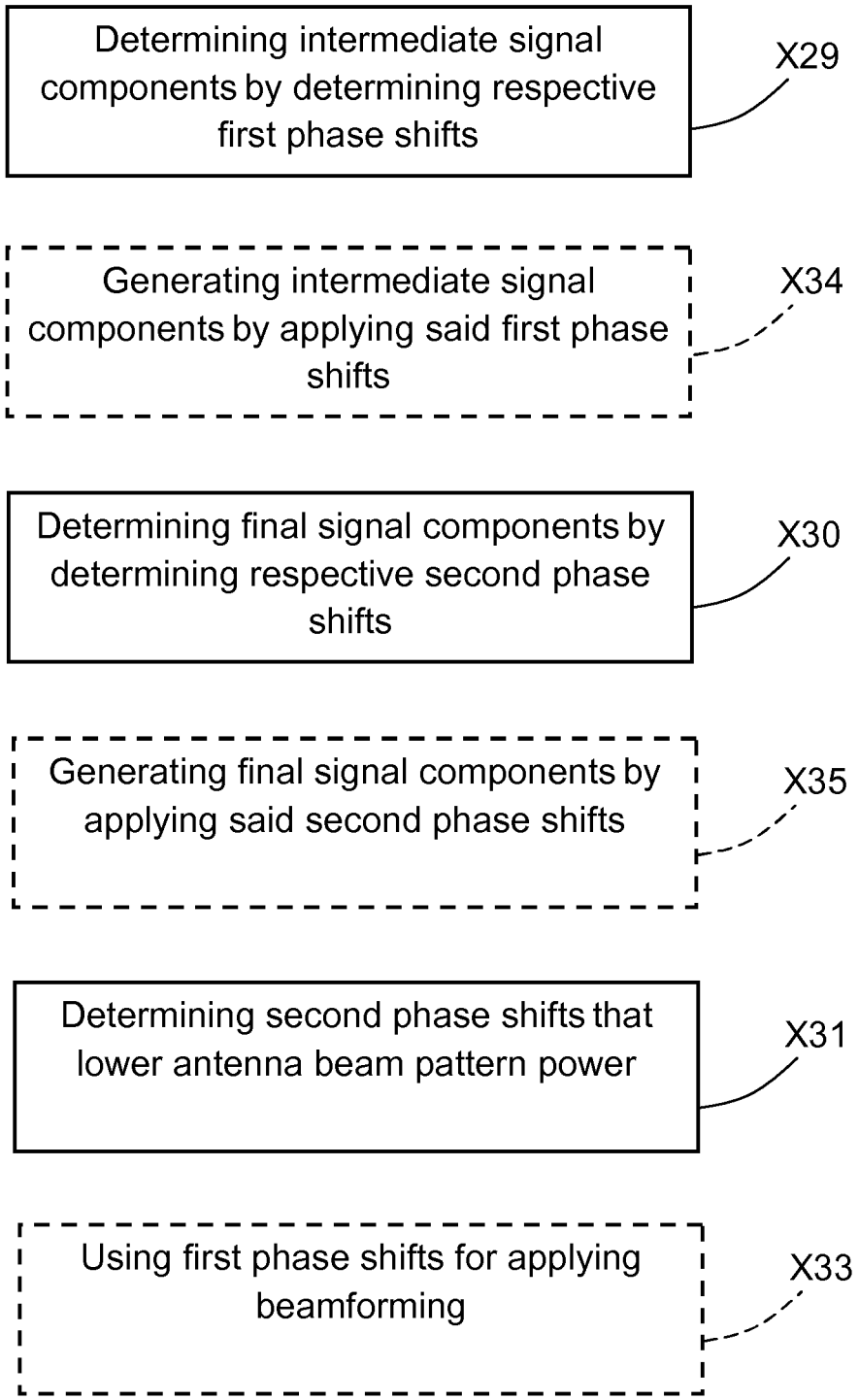
FIG. 6 illustrates a communication node arrangement according to some aspects of the present disclosure.

FIG. 6 shows a wireless communication node arrangement for controlling an antenna beam 8 for an antenna arrangement 2 with at least two antenna elements 4*a*, 4*b*, 5*a*, 5*b*, 6*a*, 6*b*, 7*a*, 7*b* in a wireless communication node 1. The communication node arrangement comprises:

A first determining module X29 configured to determine a plurality of intermediate signal components 11 from at least one input signal 10 by determining a first set of respective phase shifts $\varphi_1$, $\varphi_2$, $\varphi_3$, $\varphi_4$; $\theta_1$, $\theta_2$, $\theta_3$, $\theta_4$, $\theta_5$, $\theta_6$, $\theta_7$, $\theta_8$ for said input signal 10;

A second determining module X30 configured to determine a final signal component 12 for each antenna element 4*a*, 4*b*, 5*a*, 5*b*, 6*a*, 6*b*, 7*a*, 7*b* from said intermediate signal components 11 by determining a second set of respective phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_8$ for said intermediate signal components 11; and A third determining module X31 configured to determine the second set of phase shifts $\beta_1$, $\beta_2$, $\beta_3$, $\beta_4$; $\Phi_1$, $\Phi_2$, $\Phi_3$, $\Phi_4$, $\Phi_5$, $\Phi_6$, $\Phi_7$, $\Phi_8$ such that a lowered gain of the antenna arrangement 2, 2', 2" in at least one direction D is provided, such that the possible antenna beam patterns achievable by adjustment of said first phase shifts is constrained.

According to some aspects, the communication node arrangement further comprises an optional beamforming module X33 configured to use the first set of phase shifts for applying beamforming.

According to some aspects, the communication node arrangement further comprises an optional first generating module X34 configured to generate intermediate signal components 11 by applying the first set of phase shifts $\varphi_1$, $\varphi_2$, $\varphi_3$, $\varphi_4$ to said input signal 10, and an optional second generating module configured to generate the final signal components 12 by applying the second set of phase shifts $\beta_1$, $\beta_2$, $\beta_3$, $\beta_4$ to the intermediate signal components 11.

The invention claimed is:

1. A wireless communication node, comprising:

at least one antenna arrangement, each antenna arrangement comprising:

at least one antenna port;

at least two antenna elements arranged for providing a steerable antenna beam pattern; and a phase control arrangement configured to:

receive at least one input signal via the at least one antenna port;

determine a plurality of intermediate signal components from the at least one input signal by determining a first set of respective phase shifts for the at least one input signal; and determine a final signal component for each antenna element from the plurality of intermediate signal components by determining a second set of respective phase shifts for the plurality of intermediate signal components, wherein the second set of phase shifts is arranged to provide a null in the steerable antenna beam pattern in a predetermined direction while a main lobe of the steerable antenna beam pattern is steered in different directions.

2. The wireless communication node of claim 1, wherein the first set of phase shifts is arranged for applying beamforming.

3. The wireless communication node of claim 1, wherein the phase control arrangement comprises:

a first phase control module configured to receive a first phase control signal; and a second phase control module configured to receive a second phase control signal, wherein the first phase control module is configured to generate the plurality of intermediate signal components by applying the first set of phase shifts, which has been determined by means of the first phase control signal, to the at least one input signal, and wherein the second phase control module is configured to receive the plurality of intermediate signal components and to generate the final signal components by applying the second set of phase shifts, which has been determined by means of the second phase control signal, to the plurality of intermediate signal components.

4. The wireless communication node of claim 3, wherein a control unit is arranged to form and transmit appropriate phase control signals.

5. The wireless communication node of claim 3:

wherein the first phase control module comprises a first set of phase shifting devices configured to generate the first set of phase shifts; and wherein the second phase control module comprises a second set of phase shifting devices configured to generate the second set of phase shifts.

6. The wireless communication node of claim 3:

wherein the first phase control module comprises a digital signal processing unit that is configured to determine and generate the first set of phase shifts; and wherein the second phase control module comprises a second set of phase shifting devices configured to generate the second set of phase shifts.

7. The wireless communication node of claim 6, wherein the first phase control module comprises distributed amplifiers.

8. The wireless communication node of claim 3, wherein each antenna arrangement comprises at least two sub-arrays, each sub-array comprising two antenna elements and one phase shifting device.

9. The wireless communication node of claim 8, wherein the at least two sub-arrays comprised in the antenna arrangement are identical.

10. The wireless communication node of claim 1, wherein the first set of phase shifts comprises adaptable phase shifts, and the second set of phase shifts comprises predetermined phase shifts.

11. The wireless communication node of claim 1:

wherein the phase control arrangement comprises a digital signal processing unit configured to:

determine the first set of phase shifts and the second set of phase shifts; and combine the first set of phase shifts and the second set of phase shifts to form a set of combined phase shifts, and wherein the phase control arrangement is configured to generate the final signal components by applying the set of combined phase shifts to the at least one input signal.

12. The wireless communication node of claim 1, wherein phase shifts in the second set of phase shifts have mutually equal values.

13. The wireless communication node of claim 11, wherein a control unit is configured to form and transmit appropriate phase control signals to the digital signal processing unit.

14. The wireless communication node of claim 1, wherein each antenna arrangement is part of a reconfigurable antenna system in a self-organizing network.

15. A method for controlling an antenna beam for an antenna arrangement in a wireless communication node, the antenna arrangement having at least two antenna elements, the method comprising:

determining a plurality of intermediate signal components from at least one input signal by determining a first set of respective phase shifts for the at least one input signal;

determining a final signal component for each antenna element from the plurality of intermediate signal components by determining a second set of respective phase shifts for the plurality of intermediate signal components; and determining the second set of phase shifts to provide a null in an antenna beam pattern aligned in a predetermined direction while a main lobe of the antenna beam pattern is steered in different directions.

16. The method of claim 15, further comprising using the first set of phase shifts for applying beamforming.

17. The method of claim 15, further comprising:

generating the plurality of intermediate signal components by applying the first set of phase shifts to the at least one input signal; and generating the final signal components by applying the second set of phase shifts to the plurality of intermediate signal components.

18. The method of claim 15:

wherein a first set of phase shifting devices is used for generating the first set of phase shifts; and wherein a second set of phase shifting devices is used for generating the second set of phase shifts.

19. The method of claim 15:

wherein a digital signal processing unit is used for generating the first set of phase shifts; and wherein a second set of phase shifting devices is used for generating the second set of phase shifts.

20. The method of claim 15, wherein the first set of phase shifts has adaptable phase shifts, and the second set of phase shifts has predetermined phase shifts.

21. The method of claim 15, wherein the phase shifts in the second set of phase shifts have mutually equal values.

22. The method of claim 5:

wherein a digital signal processing unit is used to determine the first set of phase shifts and the second set of phase shifts;

wherein the digital signal processing unit is used to combine the first set of phase shifts and the second set of phase shifts to form a set of combined phase shifts; and wherein a phase control arrangement is used to generate the final signal components by applying the set of combined phase shifts to the at least one input signal.

23. The method of claim 15, wherein the method is used in a reconfigurable antenna system in a self-organizing network.

* * * * *